US012564215B2

(12) United States Patent
Ademe et al.

(10) Patent No.: US 12,564,215 B2
(45) Date of Patent: Mar. 3, 2026

(54) PAPER SHEET FILTER ELEMENT FOR A SMOKING ARTICLE, AND ASSOCIATED METHOD

(71) Applicant: R.J. Reynolds Tobacco Company, Winston-Salem, NC (US)

(72) Inventors: Balager Ademe, Winston-Salem, NC (US); Paul Stuart Chapman, Winston-Salem, NC (US); Wesley Steven Jones, Lexington, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 181 days.

(21) Appl. No.: 17/338,015

(22) Filed: Jun. 3, 2021

(65) Prior Publication Data

US 2021/0378290 A1 Dec. 9, 2021

Related U.S. Application Data

(60) Provisional application No. 63/034,856, filed on Jun. 4, 2020.

(51) Int. Cl.

| | |
|---|---|
| ***A24D 3/02*** | (2006.01) |
| ***A24D 3/04*** | (2006.01) |
| ***A24D 3/06*** | (2006.01) |

(52) U.S. Cl.

CPC ..... *A24D 3/048* (2013.01); *A24D 3/061* (2013.01)

(58) Field of Classification Search

CPC ..... A24D 3/048; A24D 3/061; A24D 3/0212; A24D 3/163; A24D 3/02

See application file for complete search history.

(56) References Cited

U.S. PATENT DOCUMENTS 2,820,461 A * 1/1958 Paul ..... A24D 3/04 55/522
2,966,157 A * 12/1960 Mumpower ..... B01D 39/1623 131/331
3,173,426 A * 3/1965 Touey ..... A24D 3/0204 131/332

(Continued)

FOREIGN PATENT DOCUMENTS

CN 111109641 A * 5/2020 ..... A24D 3/0212
GB 2 260 477 4/1993

(Continued)

OTHER PUBLICATIONS

English machine translation of CN111109641A, Lin, May 2020, 5 pages. (Year: 2020).*

(Continued)

*Primary Examiner* — Linda L Gray
(74) *Attorney, Agent, or Firm* — Womble Bond Dickinson (US) LLP

(57) ABSTRACT

A filter element for use in a smoking article includes a filter material comprised of paper sheet having a crimped three-dimensional structure. Polyethylene glycol, triethyl citrate, or triacetin is interacted with the filter material to increase the selective removal of semi-volatile compounds from mainstream smoke being drawn through the filter element, over the filter material alone. An associated method of making a filter element for use in a smoking article is also provided.

10 Claims, 2 Drawing Sheets

(56) References Cited

U.S. PATENT DOCUMENTS

Figure 1:
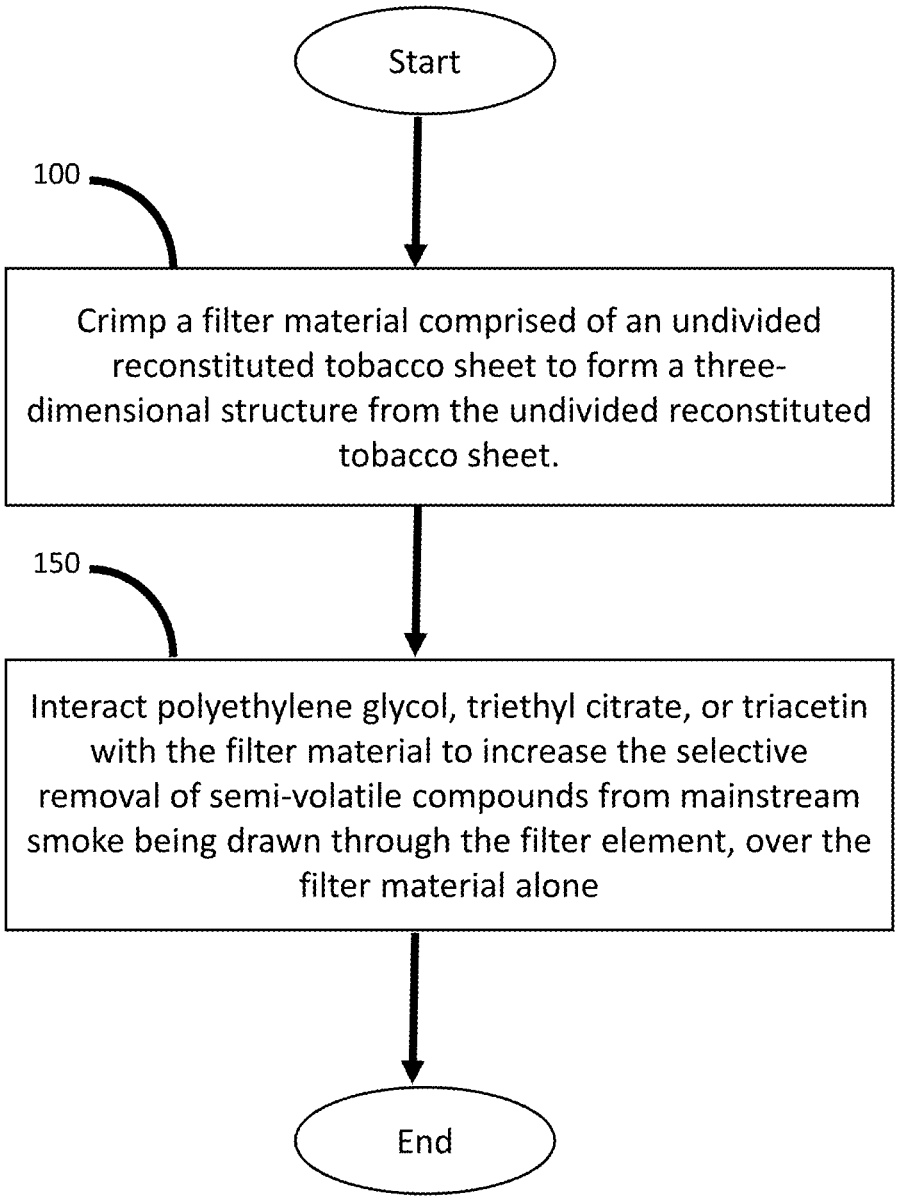

| | | | | | |
|---|---|---|---|---|---|
| 3,353,543 | A * | 11/1967 | Sproull | A24D 3/163 | 131/342 |
| 3,370,592 | A * | 2/1968 | Schultz | A24D 3/04 | 493/40 |
| 4,291,711 | A | 9/1981 | Berger | | |
| 9,107,454 | B2 | 8/2015 | Rushforth et al. | | |
| 2006/0207620 | A1 * | 9/2006 | Plunkett | A24D 3/163 | 131/331 |
| 2012/0305015 | A1 | 12/2012 | Sebastian et al. | | |
| 2015/0001148 | A1 | 1/2015 | Pan et al. | | |

FOREIGN PATENT DOCUMENTS

| | | | | | |
|---|---|---|---|---|---|
| GB | 2 261 152 | | 5/1993 | | |
| JP | 2013507949 | A | 3/2013 | | |
| KR | 20140039461 | A | 4/2014 | | |
| NO | 128937 | B * | 2/1974 | A24D 3/045 | |
| WO | WO 2008/150130 | | 12/2008 | | |
| WO | WO2011077138 | A1 * | 6/2011 | A24D 3/02 | |
| WO | WO 2011/141735 | | 11/2011 | | |
| WO | WO2014207704 | A2 * | 12/2014 | B01D 39/18 | |
| WO | WO 2019/149742 | | 8/2019 | | |

OTHER PUBLICATIONS

English machine translation of NO128937B, Horsewell, Feb. 1974, 4 pages. (Year: 1974).*

Office Action issued Sep. 6, 2024, in corresponding Russian patent application No. 2022131400.

* cited by examiner

PAPER SHEET FILTER ELEMENT FOR A SMOKING ARTICLE, AND ASSOCIATED METHOD

CROSS-REFERENCE TO RELATED APPLICATIONS

This application claims the benefit of U.S. Provisional Patent Application Ser. No. 63/034,856 to Ademe et al., filed Jun. 4, 2020, which is entirely incorporated herein by reference.

BACKGROUND

Field of the Disclosure

Aspects of the present disclosure relate to filter elements for smoking articles and, more particularly, to a paper filter element and associated method of making such a filter element.

Description of Related Art

A wide variety of fibrous materials have been suggested as filters for cigarette smoke. Cellulose acetate tow is the most commonly used filter material. One disadvantage associated with this filter material is, however, that it is slow to degrade. Whilst most of the components of a spent smoking article dissociate into their individual constituent parts and degrade within a relatively short period of time when exposed to moisture and/or mechanical abrasion, cellulose acetate filter material is slow to degrade because the cellulose acetate fibers themselves are effectively not water soluble and therefore poorly biodegradable.

Non-woven sheet materials and paper may also be used as filter materials in smoking articles. For example, crepe paper (also referred to as crimped or gathered paper) has been used as filter material. Non-woven sheet materials and paper are more readily biodegradable than the cellulose acetate. However, they currently have drawbacks when used as filter materials. In order to attain the desired structural rigidity when constructing a filter element from non-woven sheet materials and paper, the filter material must be very densely packed and this means that these filter elements have quite different properties to those made of cellulose acetate. They exhibit a greater resistance to the flow of smoke, resulting in a pressure drop which is higher than that of a conventional cellulose acetate filter, requiring the user to draw harder on the smoking article. Perhaps more significantly, the smoke drawn through such filter material has been found to have different taste characteristics compared to the smoke drawn through conventional cellulose acetate filter material. What is more, filter elements comprising non-woven sheet materials or paper as the filter material have been shown to exhibit significantly less selective removal of semi-volatile compounds than conventional cellulose acetate tow filter materials.

Additives such as triacetin (glycerin triacetate), TEC (triethyl citrate) and PEG (polyethylene glycol) have been used in conventional cellulose acetate (CA) filters as well as paper/nonwoven filters. These additives are plasticizers and they are used in CA filters to bind adjacent fibers, in order to give the filter rods sufficient hardness for cigarette manufacture and use. Plasticized cellulose acetate tow is also known to improve the selective removal of semi-volatile compounds found in smoke (e.g. phenol, o-cresol, p-cresol and m-cresol). For this effect, it appears to be necessary for the plasticizer to be present on the surface of the CA fibers. Because of the fiber-binding effect of plasticizers, CA filters are generally disclosed as including less than 10% plasticizer. It has been found that including more plasticizer has a detrimental effect on the cellulose acetate tow, including causing holes to be formed in the CA tow material.

While the inclusion of plasticizers such as triacetin, TEC or PEG in CA filters is relatively common, their inclusion in non-woven sheet and paper filter materials may be less attractive. Firstly, the plasticizers are used in CA filters to bind fibers and the plasticizer would clearly not have this advantageous effect when added to non-woven sheet material or paper (in which the fibers are already bound within the sheet structure). Secondly, it has been suggested that triacetin and TEC do not particularly improve the selective removal of semi-volatile compounds when used in paper filter materials. Thirdly, these commonly used plasticizers are liquids and their application to non-woven sheet and paper filter materials will be limited as they will cause these materials to become soggy and/or to lose their structural integrity.

Thus, there exists a need for a filter element which is more readily degradable than filter elements comprising a conventional cellulose acetate filter material, wherein such a filter element also exhibits good selective removal of semi-volatile compounds from mainstream smoke drawn through the filter element, and which provides a mainstream smoke drawn therethrough having taste characteristics and sensory effects similar to that provided by conventional cellulose acetate filters.

SUMMARY

The above and other needs are met by aspects of the present disclosure which, in one aspects, provides a filter element for use in a smoking article, including a filter material comprised of paper sheet having a crimped three-dimensional structure. Polyethylene glycol, triethyl citrate, or triacetin is interacted with the filter material to increase the selective removal of semi-volatile compounds from mainstream smoke being drawn through the filter element, over the filter material alone.

Another aspect of the disclosure provides a method of making a filter element for use in a smoking article. Such a method comprises crimping a filter material comprised of a paper sheet to form a three-dimensional structure from the paper sheet; and interacting polyethylene glycol, triethyl citrate, or triacetin with the filter material to increase the selective removal of semi-volatile compounds from mainstream smoke being drawn through the filter element, over the filter material alone.

According to another aspect of the disclosure, a filter element is provided comprising filter material which is a reconstituted tobacco paper sheet or other reconstituted botanical paper sheet material, in addition to (i) polyethylene glycol in an amount sufficient to increase the selective removal of semi-volatile compounds from the smoke being drawn through the filter element; (ii) TEC in an amount sufficient to improve the taste characteristics of smoke drawn through the filter element; or (iii) triacetin in an amount sufficient to improve the taste characteristics of smoke drawn through the filter element.

In other aspects of the disclosure, there is provided a filter comprising one or more filter elements as disclosed herein. In yet other aspects of the disclosure, there is provided a smoking article comprising a filter element as disclosed herein, and/or a filter comprising one or more filter elements as described herein, attached to a rod of smokeable material. The smoking article may be a cigarette. In still further aspects, there is provided the use of polyethylene glycol, TEC or triacetin to improve the selective removal of semi-volatile compounds by a filter element comprising reconstituted tobacco paper sheet or other reconstituted botanical paper sheet as the filter material and for improving the taste characteristics of the mainstream smoke drawn through said filter element. As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products and carbon-tipped tobacco heating products.

BRIEF DESCRIPTION OF THE SEVERAL VIEWS OF THE DRAWING(S)

Figure 2:
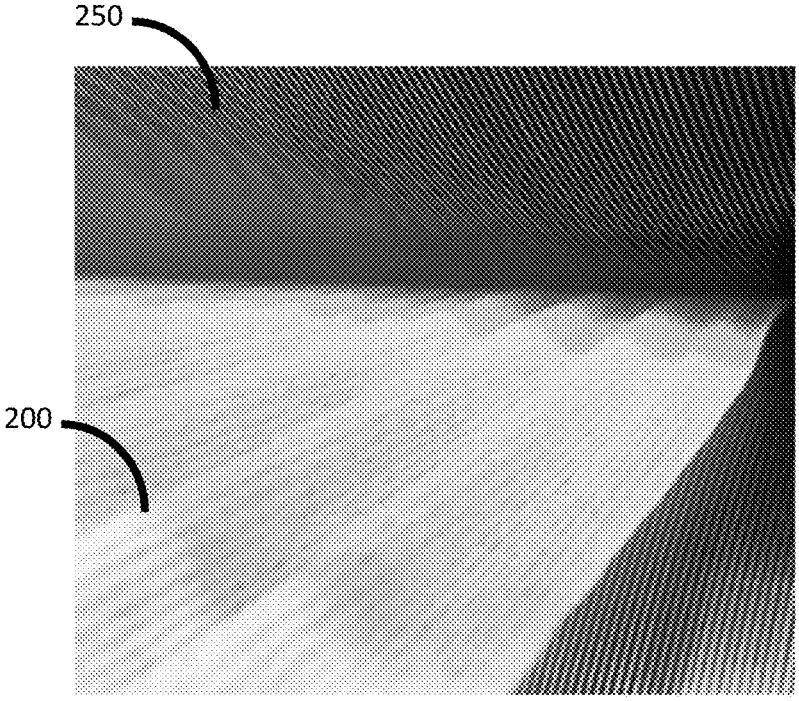
Figure 3:
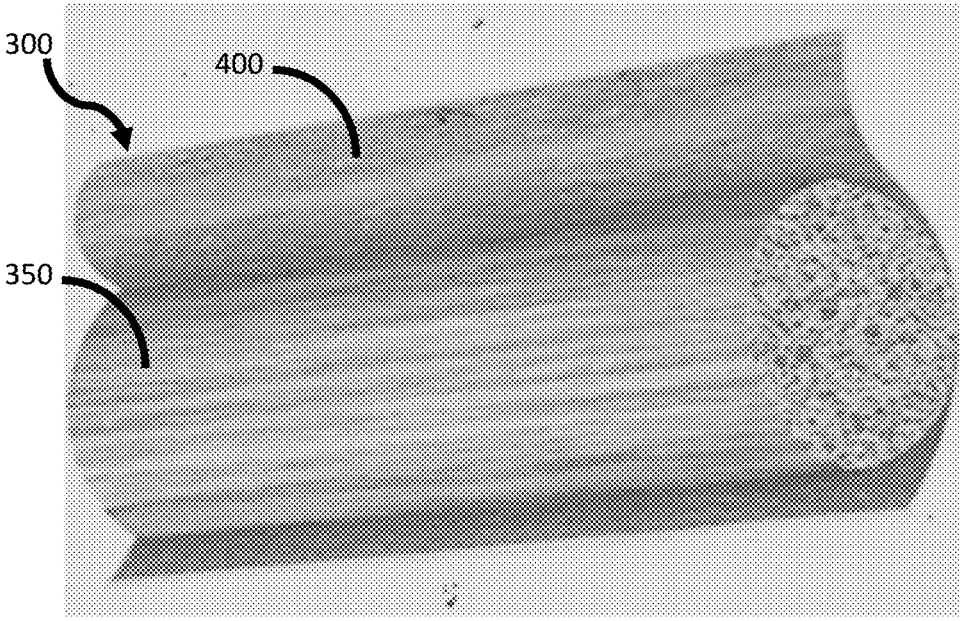

Having thus described the disclosure in general terms, reference will now be made to the accompanying drawings, which are not necessarily drawn to scale, and wherein:

FIG. 1 schematically illustrates a method of making a filter element for use in a smoking article, according to one aspect of the present disclosure;

FIG. 2 schematically illustrates a crimped paper sheet formed in a crimping unit; and FIG. 3 schematically illustrates a cigarette filter element, according to one aspect of the present disclosure.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

The addition of PEG, TEC and/or triacetin to paper filters for phenol reduction and to bring their performance more into line with cellulose acetate filters has been disclosed. However, such disclosure does not appear to mention or address alternative paper materials, such as reconstituted tobacco paper sheet or other reconstituted botanical paper sheet, which may have different properties and thus require different processing than regular paper. For example, reconstituted tobacco paper sheet may have to be shredded or cut into strands in order to form a "paper filter." Moreover, some general shortcomings of paper filters, such as lack of structural strength particularly upon being treated with a liquid, and a high resistance to draw when formed into a filter, must be overcome.

Some aspects of the present disclosure thus involve paper filters/paper filter elements for smoking articles based on alternative paper types such as, for example, reconstituted tobacco paper sheet material or other reconstituted botanical paper sheet material. In particular aspects, the reconstituted tobacco paper sheet or other reconstituted botanical paper sheet is implemented in undivided form (e.g., the sheet material is not shredded or cut into strands in order to form the filter element). Instead, a modifier, such as triacetin, triethyl citrate (TEC), PEG, etc. is applied either separately or in combination to the reconstituted tobacco paper material prior to or during the crimping and gathering and/or filter rod formation process. For example, the modifier can be applied to the sheet filter material in conjunction with the crimping process (e.g., by spraying), or can be injected into the filter material in the garniture region, upon the sheet filter material being formed into a continuous filter rod. The addition of such modifier(s) may thus improve the sensory profile of an alternative paper filter to mimic (e.g., in terms of "taste," "mouth feel," etc.) a traditional cellulose acetate (CA) filter. One skilled in the art will appreciate that even though the additives/modifiers triacetin, TEC, and PEG are discussed herein, many different additives/modifiers or combinations thereof may also be capable of accomplishing the objectives noted herein. As such, the aspects of the disclosure herein are not limited to the additives/modifiers triacetin, TEC, and PEG.

That is, some aspects of the present disclosure involve a "paper filter" for a smoking article, wherein the "paper filter" is made from reconstituted tobacco paper sheet material (or other reconstituted botanical paper sheet material) that is not shredded or cut into strands to form the filter element, but instead the undivided reconstituted tobacco paper sheet 200 is subject to a crimping process (see, e.g., FIG. 2) using, for example, a crimping unit 250 to provide a three-dimensional structure of the sheet material for achieving sufficient structural strength for forming the filter element (see, e.g., step 100 in FIG. 1). For example, the crimping unit 250 may be arranged such that the crimping rollers thereof are oriented in a longitudinal or machine direction. In addition, the sheet material is treated with a single additive such as triacetin, TEC, or PEG (e.g., a plasticizer) to thus provide a resulting "paper filter" capable of removing certain components of the mainstream smoke filtered through the resulting filter element (see, e.g., step 150 in FIG. 1). Such an additive can be applied to the reconstituted tobacco paper (or other botanical paper) sheet material using, for example, an additive dispensing unit associated with the crimping unit. In this manner, a reconstituted tobacco paper sheet formed into a "paper filter" having performance similar to a conventional cellulose acetate filter, and a method of manufacturing such a reconstituted tobacco "paper filter" (as shown, for example, in FIG. 1) are achieved.

The thickness of the sheet material can vary, and typically is dependent upon the composition and strength of the material, other desired properties a the sheet material, and other such factors. Generally, the thickness of the sheet material is sufficient to provide suitable strength to endure the processing stages thereof (including the deformation into the three-dimensional structure achieved by the crimping process), and ultimately to provide a filter rod demonstrating the desired properties. In particular aspects, the thickness of the sheet material (e.g., comprised of reconstituted tobacco paper sheet or other reconstituted botanical paper sheet) ranges from about 0.001 inch to about 0.05 inch, preferably from about 0.003 inch to about 0.01 inch, more preferably from about 0.003 inch to about 0.006 inch. In particular aspects, the sheet material has a basis weight of about 15 $g/m^2$ to about 60 $g/m^2$ or more, or preferably about 20 $g/m^2$ to about 55 $g/m^2$.

In particular aspects, as shown, for example, in FIG. 3, the filter element 300 has a longitudinally extending core 350 comprised of the filter material, and a wrapper 400 which surrounds the core. The wrapper of the filter element is preferably a paper wrapper. In one aspect, the wrapper is conventional plug wrap. The wrapper for use in the filter element of the present disclosure may be porous or non-porous. The wrapper for use in the filter element may be ventilated or unventilated. In one aspect, the wrapper may be a conventional plug wrap which covers 360° of the core and about a central axis, in which case the plug wrap has a lapped and adhered seam securing the wrapper around the core. Where an adhesive is used to hold the wrapper seam in place, the adhesive is preferably one which is water-dispersible. In another aspect, the wrapper (in particular, plug wrap) does not extend 360° around the core. That is, in one aspect, the wrapper is a split wrapper which extends circumferentially about the core, but extends less than 360° around the circumference of the core. In such an aspect, there is no lapped and adhered seam holding the wrapper around the core, but instead, the split wrapper may be secured in place in other known manners, such as for example by bonding the wrapper directly to the core.

In one aspect, the filter element according to the present disclosure further comprises particulate material. The particulate material can include, for example, sorbents (e.g., selected from activated carbon, charcoal, silica gel, sepiolite, alumina, ion exchange material, etc.), pH modifiers (e.g., alkaline materials such as $Na_2CO_3$, acidic materials), flavorants, other solid additives, and mixtures and combinations thereof. The particulate material can also be selected from a group of relatively high surface area materials capable of adsorbing smoke constituents without a high degree of specificity. Suitable general adsorbents can be selected from the group consisting of carbon, activated carbon, activated charcoal, activated coconut carbon, activated coal-based carbon or charcoal, zeolite, silica gel, meerschaum, aluminum oxide (activated or not), carbonaceous resin, or combinations thereof. In one aspect, the particulate material used herein is carbon, for instance activated carbon, or charcoal or other adsorbent material. In one aspect, preferably the activated carbon is activated coconut carbon.

Any particulate material used may be a single substance or a mixture, and/or may be in admixture with other material(s). The particulate material may be interspersed throughout the core of filter material. Alternatively, the particulate material may be interspersed in some parts (but not all) of the core. The parts may be evenly or unevenly distributed. The particulate material may extend over the full longitudinal length of the core. Alternatively, the particulate material may extend from one end of the core to a section that is short of the other end. Alternatively, the particulate material may be present in discrete areas that need not extend from, or be present at, any end of the core. Different areas may have different loadings of particulate material and/or different types of particulate material.

Another option for including particulate material in a filter element is to adhere the particles to a wrapper surrounding the filter element. GB 2260477 and GB 2261152 describe various configurations of additive adhesion. In one aspect, the wrapper of the filter element comprises a particulate material adhered to one or more portions of the wrapper. Preferably, the particulate material is adhered to two or more portions of the wrapper, the portions being circumferentially spaced from one another and at least one of said two or more portions extending over the full longitudinal length of said wrapper.

In some aspects, in addition to having adsorbent particulate material adhered to the wrapper, the core may further comprise particulate material interspersed in the filter material. The particulate material interspersed in the core may be the same as the particulate material adhered to the wrapper. Alternatively, the particulate material interspersed in the core may be different from the particulate material adhered to the wrapper. The particulate material in the core may be homogeneous, being made up of substantially the same component. Alternatively, the particulate material interspersed in the core may be heterogeneous, being made up of two or more different components.

The particulate material may be adhered to the wrapper and/or to the filter material, for example, by hot melt adhesive (e.g., various polyester adhesives), high melting point polyethylene glycol, or an emulsion-type adhesive such as PVA. The particulate material may be directly or indirectly adhered to the wrapper and/or to the sheet filter material. An example of direct adherence is where the particulate material is affixed to the sheet filter material and/or wrapper (such as the inner surface thereof) by way of a suitable adhesive. An example of indirect adherence is where the particulate material is affixed to an intermediate layer (which may be made of paper or other suitable support matrix, such as a textile material, or combinations thereof) by way of a suitable adhesive, and wherein the intermediate layer is affixed to the filter material and/or wrapper (such as the inner surface thereof) by way of a suitable adhesive.

Some filter elements according to the disclosure may exhibit a pressure drop of greater than about 40 mm of water at an airflow rate of 17.5 $cm^3/s$ per 0.1 g of filter material. In some instances, the filter element also preferably exhibits a filtration efficiency for particulate matter of mainstream tobacco smoke of less than about 15% per 0.1 gram of filter material.

As further disclosed herein, the present disclosure includes additives in the filter element to increase the selective removal of semi-volatile compounds from the mainstream smoke being drawn through the filter element, and to improve the taste characteristics or draw performance of the mainstream smoke drawn through the filter element. The selective removal of semi-volatile compounds is provided by the additive (e.g., plasticizer) polyethylene glycol. TEC and/or triacetin, which have been found to improve the taste characteristics of mainstream smoke drawn through the filter element. These additives allow the use of the alternative (e.g., reconstituted tobacco paper or other reconstituted botanical paper) filter material to be fine-tuned, so that the performance of the filter element can more closely resemble that of a cellulose acetate filter element. The additives also give the use of these alternative paper filter materials much greater flexibility, widening the range of the applicability thereof while retaining the beneficial biodegradable properties of the filter element.

In some instances, the inclusion of the additives to the reconstituted tobacco paper (or other botanical paper) sheet material may increase the biodegradation of the filter element. Filter elements according to the present disclosure, including any one of the three additives PEG, TEC, or triacetin, may exhibit increased biodegradation when exposed to environmental conditions than an equivalent cellulose acetate filter element or a paper filter element without an additive.

The filter material, according to some aspects, comprises gathered, pleated, crimped, or creped reconstituted tobacco paper or other botanical paper. Such reconstituted tobacco paper (or other botanical paper) filter material tends to have a low air permeability, exhibit a basic pH, and can be gathered, pleated, or otherwise formed to form the filter element.

In one aspect of the disclosure, the polyethylene glycol is a high molecular weight polyethylene glycol, preferably one which is solid at room temperature. Such polyethylene glycols include PEG 600 and higher, and preferably PEG 1000 and higher. These particular polyethylene glycols may be advantageous as being solid (or semi-solid) at room temperature such that the addition thereof will not compromise the structural integrity of the reconstituted tobacco paper (or other botanical paper) filter material. Additives which are liquid at room temperature can adversely affect the structural integrity and strength of a filter element where the filter material is comprised of a paper material and may therefore limit the amount of such additives which can be included while still retaining the required rigidity and strength of the resulting filter element. Rather than weakening the paper material, the use of a high molecular weight polyethylene glycol may increase the structural integrity and rigidity of the filter material, so that it may be possible to use less of the filter material in the filter element. This provides further flexibility when forming the filter element with regard to the amount of filter material required to achieve the desired hardness and rigidity. This in turn would allow the pressure drop of the filter element to be adjusted. The filter element according to the present disclosure could thus be adjusted to have properties which closely resemble those of conventional cellulose acetate (CA) filter elements. One skilled in art will appreciate, however, that since other aspects of the disclosure herein are directed to improving the structural integrity/strength of the sheet filter material, the PEG implemented according to aspects of the disclosure can be in liquid form. For example, low molecular weight PEG, such as PEG 400 which is in liquid form at room temperature, may also be implemented instead of or in addition to high molecular weight PEG.

In addition, the selective removal of semi-volatile compounds provided by the addition of the PEG to the filter element is proportional to the amount of PEG included. The flexibility to add greater amounts of PEG, especially high molecular weight PEG, means that the ability of the filter element to selectively remove semi-volatile compounds may easily be adjusted to a desirable level. As PEG is water-soluble, the inclusion thereof in the filter elements should not adversely affect the biodegradation performance of the filter element. In some aspects, the addition of PEG to a filter element comprising a reconstituted tobacco paper (or other botanical paper) sheet as the filter material may enhance biodegradation of the filter element. In one aspect, the PEG is included in or on the filter material of the filter element in an amount of at least about 5% and up to about 30%, preferably up to about 20%, and more preferably of about 5-10% by weight of the filter material (e.g., by comparing the dry weight of the filter material or filter element (filter material and wrapper) without the PEG to the weight of the filter material or filter element including the PEG additive.

The addition of TEC and/or triacetin may have a different effect on the filter material than PEG. For example, TEC and/or triacetin may have a positive effect on the taste and odor (e.g., sensory perception) of the mainstream smoke drawn through the filter element. A common criticism of paper filter elements is that they tend to produce poor tasting smoke. The triacetin and TEC may have different effects on the taste characteristics of the mainstream smoke and the TEC and triacetin additives may be added in differing amounts in order to produce a desirable smoke taste profile.

In conventional cellulose acetate filter material, the amount of triacetin or TEC which can be included is limited by the effect that these additives have on binding the fibers of the fibrous material, with amounts of triacetin exceeding about 7% causing holes to be formed in the cellulose acetate material. In contrast, the amount of TEC and triacetin which may be included in or on the filter material of the present disclosure may not be as limited. In instance where PEG is also included in the interaction with the filter material (PEG being solid at room temperature), the effect of these liquid additives in making the filter material soggy is reduced or minimized. At least about 5% and up to about 30% by weight of TEC and/or triacetin may be included, although amounts of up to about 20% or up to about 12% by weight of the filter material (e.g., by comparing the dry weight of the filter material or filter element (filter material and wrapper) without the additive to the weight of the filter element including the additive) may be preferred.

In some aspects, the sheet filter material is not coated or otherwise interacted with cellulose acetate fibers. In one aspect, the filter material and/or the filter element do not include any cellulose acetate.

If necessary or desired, further additives can be incorporated into or onto the filter material including, for example, tobacco extracts, glycerine, menthol, carbon fibers, carbon particles, and the like. Such additives can be incorporated into the sheet filter material upon manufacture thereof, or applied to the sheet filter material after manufacture is complete.

In some aspects, a filter may be comprised of one or more of the filter elements as disclosed herein. In other aspects, the filter element may be the sole filter element in the filter upon formation into a smoking article rod. In yet other aspects, the filter element may be part of a larger filter, such as a composite or multi-component filter. Suitably, the filter elements of such a composite filter may be arranged longitudinally of one another with the end of each filter element abutting the next. In other instances, the composite filter may have 2, 3, 4, or more distinct or discrete sections. However, filters according to the present disclosure may be of integral construction, but have the general appearance of a composite filter. In one aspect, the filter is a triple-filter with three sections. In another aspect, the filter is a dual-filter with two sections.

In aspects involving a composite filter, there may be one or more filter elements according to the present disclosure. In instances of more than one filter element in the composite filter, the filter elements may be positioned longitudinally next to one another or be separated by another filter element. In instances where the filter element is used in a composite filter, the one or more other sections of the composite filter may comprise a biodegradable filter material, such as crepe, crimped or gathered paper material. The one or more other sections may optionally comprise one or more additives such as, for example, an adsorbent or flavoring material. In a yet further alternative aspect, the composite filter may comprise a section which forms a cavity for receiving and containing granular material.

Suitably, existing filter elements having particular pressure drop characteristics may also be utilized in a composite filter. In addition, the pressure drop and/or mechanical filtration efficiency of the various filter sections can be selected to achieve the desired smoking mechanics and filtration characteristics as may be required with the specific product design necessary or desired. In a composite filter arrangement, the pressure drop of the filtration material sections may be varied.

In some aspects, a portion of the filter element and/or the composite filter comprising said filter element may comprise a catalyst. In such instances, the catalyst may facilitate the conversion of carbon monoxide (CO) to carbon dioxide ($CO_2$) in the vapor phase of the mainstream smoke. In particular aspects, the catalyst is highly selective for carbon monoxide. Preferably the catalyst may be selected from the group consisting of transition metal oxides, silica, alumina, zeolites, impregnated carbon (e.g., carbon impregnated with metals), and combinations thereof.

In some aspects, the tobacco-rod end of a composite filter may define a cavity containing an adsorbent and/or a catalyst and/or, alternatively, may comprise a smoke filtration material having an adsorbent and/or catalyst dispersed therein. In such instances, the adsorbent is capable of retaining at least a portion of the vapor phase of mainstream smoke.

Smoking articles according to the present disclosure may comprise a filter element as disclosed herein and/or a filter implementing such a filter element and attached to a rod comprising a smokable filler material (e.g., tobacco). The smoking article may be a cigarette. The filter element and/or the filter comprising said filter element may be attached to a wrapped smokeable filler material rod (e.g., a wrapped tobacco rod) by conventional tipping overwrap to form a smoking article. The tipping overwrap may be ventilated or non-ventilated overwrap. The smokable filler material may be tobacco material or a tobacco substitute material. Preferably the smokable material is a tobacco material. The tobacco material may comprise one or more of a stem, a lamina, and tobacco dust. In some aspects, the tobacco material comprises one or more of the following types: Virginia or flue-cured tobacco, Burley tobacco, Oriental tobacco, reconstituted tobacco. In other aspects, the smokable material comprises a blend of tobacco material such as, for example, 10-80% Virginia tobacco, 10-60% Burley tobacco, 0-20% Oriental tobacco, 0-120% reconstituted tobacco and 0-30% expanded tobacco.

The smokable material of smoking articles comprising a filter element according to aspects of the disclosure and/or a filter comprising a filter element according to aspects of disclosure may comprise cut tobacco, expanded tobacco, reconstituted tobacco, or a tobacco substitute material. The smokable material may also comprise one or more of the following: a burn additive, an ash improver, an inorganic filler material, an organic filler, an aerosol generating arrangement, a binder, flavoring, and/or coloring agents.

Many modifications and other embodiments of the inventions set forth herein will come to mind to one skilled in the art to which these disclosed embodiments pertain having the benefit of the teachings presented in the foregoing descriptions and the associated drawings. Therefore, it is to be understood that embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

It should be understood that although the terms first, second, etc. may be used herein to describe various steps or calculations, these steps or calculations should not be limited by these terms. These terms are only used to distinguish one operation or calculation from another. For example, a first calculation may be termed a second calculation, and, similarly, a second step may be termed a first step, without departing from the scope of this disclosure. As used herein, the term "and/or" and the "/" symbol includes any and all combinations of one or more of the associated listed items.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof. Therefore, the terminology used herein is for the purpose of describing particular embodiments only and is not intended to be limiting.

That which is claimed:

1. A method of making a filter element for use in a smoking article, consisting of:

only crimping a filter material comprised of a paper sheet to form a three-dimensional structure from the paper sheet; and interacting polyethylene glycol, triethyl citrate, or triacetin with the filter material, by applying polyethylene glycol, triethyl citrate, or triacetin to the filter material during only crimping the filter material, to increase the selective removal of semi-volatile compounds from mainstream smoke being drawn through the filter element, over the filter material alone.

2. The method of claim 1, further consisting of wrapping a plug wrap material about the filter material having the polyethylene glycol, triethyl citrate, or triacetin interacted therewith.

3. The method of claim 1, wherein only crimping the filter material consists of only crimping the filter material comprised of an undivided reconstituted tobacco paper sheet.

4. The method of claim 1, wherein interacting the polyethylene glycol with the filter material consists of interacting the polyethylene glycol with the filter material in an amount of between about 5% and about 30% by weight of the filter element.

5. The method of claim 1, wherein interacting the triacetin with the filter material consists of interacting the triacetin with the filter material in an amount of between about 5% and about 30% by weight of the filter element.

6. The method of claim 1, wherein interacting the triethyl citrate with the filter material consists of interacting the triethyl citrate with the filter material in an amount of between about 5% and about 30% by weight of the filter element.

7. The method of claim 1, further consisting of including at least one adsorbent material in the filter element.

8. The method of claim 1, further consisting of including one or more additives including tobacco extracts, glycerine, flavorants, carbon particles, and carbon fibers in the filter element.

9. The method of claim 3, wherein only crimping the filter material consists of only crimping the reconstituted tobacco paper sheet having a basis weight of between about 15 $g/m^2$ and about 60 $g/m^2$.

10. The method of claim 3, wherein only crimping the filter material consists of only crimping the reconstituted tobacco paper sheet having a thickness of between about 0.001 inch and about 0.05 inch.

* * * * *